US011248613B2

(12) United States Patent
Kuroda et al.

(10) Patent No.: US 11,248,613 B2
(45) Date of Patent: Feb. 15, 2022

(54) CENTRIFUGAL COMPRESSOR

(71) Applicant: MITSUBISHI HEAVY INDUSTRIES, LTD., Tokyo (JP)

(72) Inventors: Miku Kuroda, Tokyo (JP); Chihiro Myoren, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/149,132

(22) Filed: Jan. 14, 2021

(65) Prior Publication Data

US 2021/0262475 A1 Aug. 26, 2021

(30) Foreign Application Priority Data

Feb. 25, 2020 (JP) ..... JP2020-029450

(51) Int. Cl.

| | |
|---|---|
| ***F04D 29/44*** | (2006.01) |
| ***F04D 17/12*** | (2006.01) |
| *F04D 29/42* | (2006.01) |
| *F04D 29/30* | (2006.01) |

(52) U.S. Cl.

CPC ..... *F04D 17/122* (2013.01); *F04D 29/444* (2013.01); *F04D 29/30* (2013.01); *F04D 29/4213* (2013.01); *F05D 2250/51* (2013.01); *F05D 2250/52* (2013.01); *F05D 2250/70* (2013.01)

(58) Field of Classification Search

None

See application file for complete search history.

(56) References Cited

U.S. PATENT DOCUMENTS

| | | | | |
|---|---|---|---|---|
| 4,725,196 | A * | 2/1988 | Kaneki | F04D 17/12 415/98 |
| 2015/0345507 | A1* | 12/2015 | Koga | F04D 29/462 415/148 |
| 2016/0327056 | A1* | 11/2016 | Nakaniwa | F04D 29/444 |
| 2019/0285072 | A1* | 9/2019 | Masutani | F04D 17/12 |
| 2020/0032811 | A1* | 1/2020 | Nakaniwa | F04D 17/12 |
| 2020/0300251 | A1* | 9/2020 | Yamashita | F04D 17/122 |
| 2021/0003145 | A1* | 1/2021 | Kuroda | F04D 17/12 |
| 2021/0115943 | A1* | 4/2021 | Koga | F04D 17/122 |

FOREIGN PATENT DOCUMENTS

| | | |
|---|---|---|
| JP | 2003-129997 | 5/2003 |
| JP | 2013-194687 | 9/2013 |
| JP | 2015-148192 | 8/2015 |

* cited by examiner

*Primary Examiner* — Michael Lebentritt

(74) *Attorney, Agent, or Firm* — Wenderoth, Lind & Ponack, L.L.P.

(57) ABSTRACT

A centrifugal compressor is provided with a return vane including a suction surface facing a front side in a rotation direction of a rotation shaft and a pressure surface facing a rear side. A casing includes a hub side wall surface and a shroud side wall surface that form a placement region of the return vane in the straight flow path, and an intermediate suction port formed on the shroud side wall surface, the intermediate suction port ejecting fluid guided from outside toward the straight flow path; and inside the return vane, an internal flow path is formed in which one end communicates with the intermediate suction port and another end is an outlet port that opens to the suction surface of the return vane.

7 Claims, 10 Drawing Sheets

CENTRIFUGAL COMPRESSOR

CROSS-REFERENCE TO RELATED APPLICATIONS

This application claims the benefit of priority to Japanese Patent Application Number 2020-029450 filed on Feb. 25, 2020. The entire contents of the above-identified application are hereby incorporated by reference.

TECHNICAL FIELD

The disclosure relates to a centrifugal compressor.

RELATED ART

Turbo chillers are large capacity heat source machines with a wide variety of applications, such as in air conditioning in large factories with clean rooms for electronic component manufacturing, and district heating and cooling. A known type of turbo chiller includes mainly a compressor that compresses refrigerant gas using an impeller, an evaporator, a condenser, and an economizer, with the refrigerant gas flowing from the economizer upstream past the second compression stage.

In the case of turbo chillers, a centrifugal compressor that employs a two-stage compression and two-stage expansion cycle is often used as the compressor from the perspective of performance and cost. In this type of centrifugal compressor, an intermediate suction port is provided upstream of the impeller of the second compression stage, and the refrigerant gas supplied from the economizer is supplied through this intermediate suction port as a jet stream. Furthermore, the intermediate suction port is generally provided in the vicinity of a return vane (see Japanese Unexamined Patent Application Publication No. 2013-194687A described below).

The return vane is a blade provided to remove a swirling component produced by the rotation of the impeller from the fluid prior to directing the fluid flowing radially outward from the impeller toward the impeller on the rear stage side. That is, as the return vane extends from the radially outer side to the inner side, the return vane is curved from the front side toward the rear side in the rotation direction of the impeller. The surface facing the front side in the rotation direction of the return vane is shaped with a curved rear surface that projects toward the front side. The surface facing the rear side is shaped with a curved pressure surface that is recessed toward the front side.

SUMMARY

The return vane removes the swirling flow component by changing the flow direction of the fluid as described above. For this reason, in a region on the rear surface side of the return vane near the trailing edge (downstream side), the flow may fail to follow the rear surface and separate. A significant amount of such separation leads to loss, which may affect the performance of the compressor.

The present disclosure has been made to solve the above problems, and an object of the present disclosure is to provide a centrifugal compressor with better performance.

In order to solve the problems described above, a centrifugal compressor according to the present disclosure includes:

a rotation shaft that rotates about an axial line;

an impeller provided on the rotation shaft, the impeller rotating about the axial line;

a casing that forms a return flow path including:

a return bend section that turns around the fluid flowing from the impeller radially outward to flow radially inward, and a straight flow path connected to a downstream side of the return bend section, the straight flow path guiding the fluid radially inward; and a return vane provided in a plurality in a portion of the straight flow path arranged at intervals in a circumferential direction, the return vane including a suction surface facing a front side of a rotation direction of the rotation shaft, and a pressure surface facing a rear side of the rotation direction of the rotation shaft; wherein the casing includes a hub side wall surface and a shroud side wall surface that form a placement region of the return vanes in the straight flow path, and an intermediate suction port formed on the shroud side wall surface, the intermediate suction port ejecting fluid guided from outside toward the straight flow path; and inside the return vane, an internal flow path is formed in which one end communicates with the intermediate suction port and another end is an outlet port that opens to the suction surface of the return vane.

According to the present disclosure, a centrifugal compressor with better performance can be provided.

BRIEF DESCRIPTION OF DRAWINGS

The disclosure will be described with reference to the accompanying drawings, wherein like numbers reference like elements.

DESCRIPTION OF EMBODIMENTS

Turbo Chiller Configuration

Figure 1:
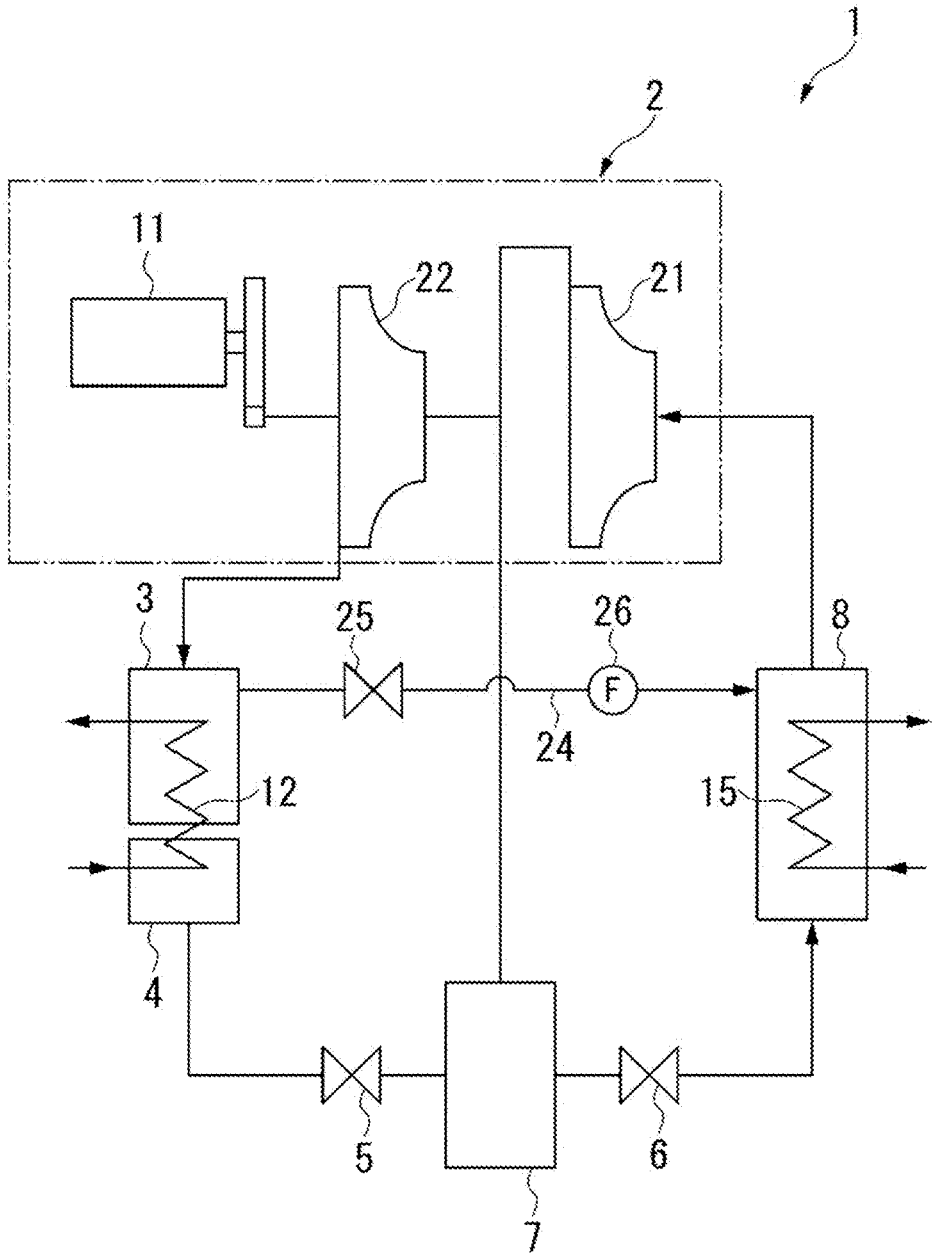
FIG. 1 is a schematic view illustrating a configuration of a turbo chiller according to an embodiment of the present disclosure.

A turbo chiller 1 (centrifugal compressor) according to an embodiment of the present disclosure is described below, with reference to the accompanying drawings. As illustrated in FIG. 1, the turbo chiller 1 according to the present embodiment includes: a compressor 2 that compresses a refrigerant, a condenser 3 that condenses a high-temperature, high-pressure refrigerant gas generated by the compressor 2, a sub-cooler 4 that performs subcooling treatment on a liquid phase refrigerant (liquid refrigerant) condensed by the condenser 3, a high-pressure expansion valve 5 that expands the liquid refrigerant from the sub-cooler 4, an economizer 7 (intercooler) connected to the high-pressure expansion valve 5 and connected to the intermediate stage of the compressor 2 and a low-pressure expansion valve 6, and an evaporator 8 that evaporates the liquid refrigerant expanded by the low-pressure expansion valve 6.

The compressor 2 is a centrifugal two-stage compressor and includes a first impeller 21 on a low pressure side and a second impeller 22 on a high pressure side. The compressor 2 is driven by an electric motor 11 with its rotational speed controlled by an inverter that changes the input frequency from the power source. The sub-cooler 4 is provided downstream of the condenser 3 with respect to the refrigerant gas and is used to provide subcooling to the condensed refrigerant. A cooling heat transfer pipe 12 for cooling the condenser 3 and the sub-cooler 4 is inserted into the condenser 3 and the sub-cooler 4. Cooling fluid flows inside the cooling heat transfer pipe 12. The refrigerant gas is condensed by coming into contact with the cooling heat transfer pipe 12.

The evaporator 8, via an endothermic process with a cold fluid, generates a refrigerant gas of a predetermined rated temperature. A cold fluid heat transfer pipe 15 is inserted into the evaporator 8.

Configuration of Centrifugal Compressor

Figure 2:
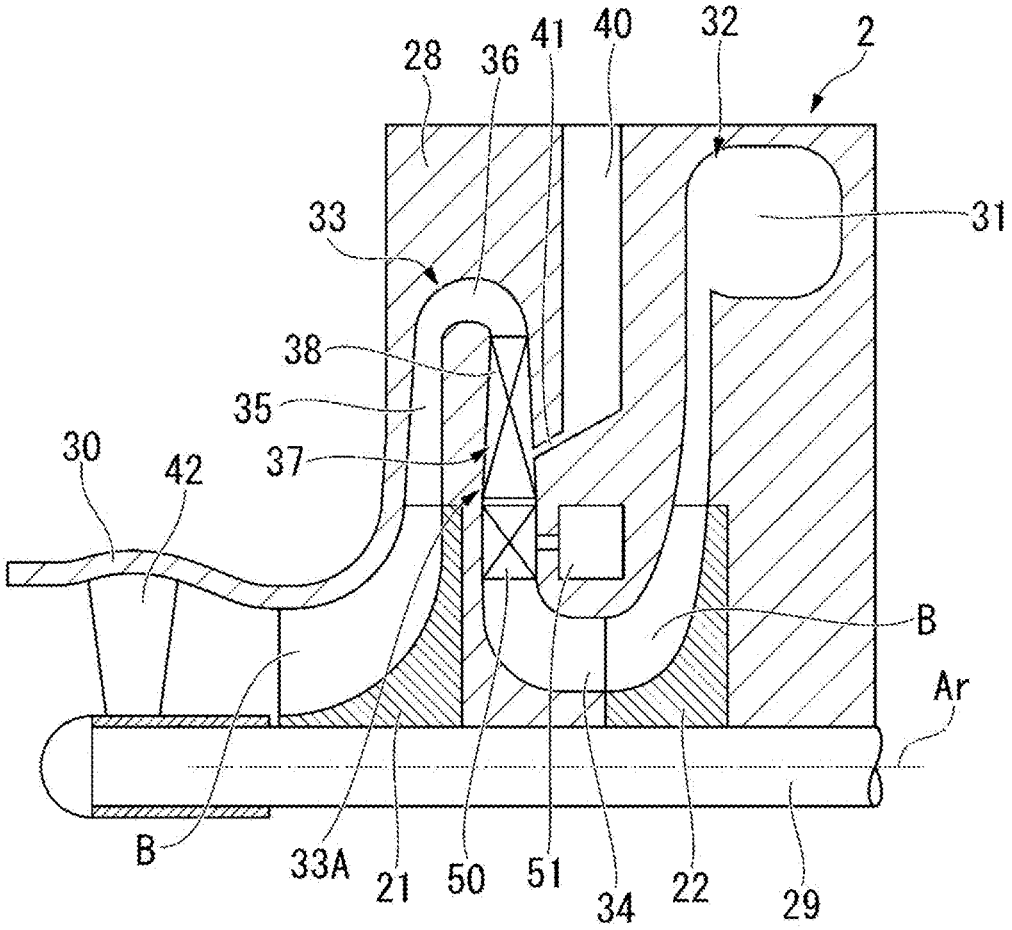
FIG. 2 is a cross-sectional view of a centrifugal compressor according to a first embodiment of the present invention taken along a plane including an axial line.

Next, the configuration of a centrifugal compressor 2 will be described with reference to FIG. 2. As illustrated in the same drawing, the centrifugal compressor 2 includes a rotation shaft 29 that extends along an axial line Ar and is rotatable about the axial line Ar, a motor (not illustrated) that rotatably drives the rotation shaft 29, the first impeller 21 and the second impeller 22 provided on the rotation shaft 29 spaced apart from one another in the direction of the axial line Ar, and a casing 28 that covers the first impeller 21 and the second impeller 22 from the outer circumferential side.

A suction port 30 for causing the refrigerant gas to flow in from outside is provided on one side in the axial line Ar direction of the casing 28. A scroll 31 that discharges the refrigerant gas is provided on the other side in the axial line Ar direction of the casing 28. An internal space 32 that connects the suction port 30 and the scroll 31 is formed in the casing 28.

The first impeller 21 and the second impeller 22 are disposed in the internal space 32. The first impeller 21 forms a first compression stage, and the second impeller 22 forms a second compression stage. The first impeller 21 and the second impeller 22 each include a plurality of blades B extending radially inward to outward relative to the axial line Ar.

The plurality of blades B are arranged at intervals in the circumferential direction with respect to the axial line Ar. A flow path for the refrigerant gas to circulate through is formed between pairs of the plurality of blades B adjacent in the circumferential direction. The flow path gradually curves from radially inward to outward as the flow path extends from one side of the axial line Ar direction toward the other side. Note that in the following description, of the both end portions of the flow path formed by the blades B, the side on which the refrigerant gas flows in (one side in the axial line Ar direction) is referred to as the upstream side, the hub side, and the like, and the side on which the refrigerant gas flows out (the other side in the axial line Ar direction) is referred to as the downstream side, the shroud side, and the like.

The internal space 32 includes a return flow path 33 connected to the downstream side of the flow path of the first impeller 21, and an intake flow path 34 (inflow flow path 34) connecting the return flow path 33 and the upstream side of the flow path of the second impeller 22. In the following description, in particular, the solid portion of the centrifugal compressor 2 that forms the return flow path 33 is referred to as a return flow path forming section 33A. That is, the return flow path 33 includes a portion of the casing 28 as the return flow path forming section 33A.

The return flow path 33 circulates the refrigerant gas from the flow path outlet on the radially outer side of the first impeller 21 toward the flow path inlet on the radially inner side of the second impeller 22. The return flow path 33 (return flow path forming section 33A) includes a diffuser 35, a return bend section 36, a straight flow path 37, a return vane 38, and an intermediate suction port 41.

The diffuser 35 guides the refrigerant gas compressed by the first impeller 21 radially outward. In the diffuser 35, the flow path area as seen from the radial direction gradually expands from the radially inner side toward the radially outward side. In a cross section that includes the axial line Ar, the wall surfaces on both sides of the diffuser 35 in the axial line Ar direction extend from radially inward to radially outward parallel to one another. The radially outward end portion of the diffuser 35 is turned around radially inward via the return bend section 36, and then communicates with the straight flow path 37. Note that the wall surfaces on both sides of the diffuser 35 in the axial line Ar direction need not necessarily be perfectly parallel, and may be substantially parallel.

In a cross section including the axial line Ar, the return bend section 36 is curved with its central portion projecting radially outward. In other words, the return bend section 36 has an arcuate shape that connects the outlet of the diffuser 35 and the inlet of the straight flow path 37. The straight flow path 37 extends from the downstream end portion of the return bend section 36 radially inward. A plurality of the return vanes 38 are arranged radially about the axial line Ar in the straight flow path 37. The straight flow path guides the fluid radially inward.

Figure 3:
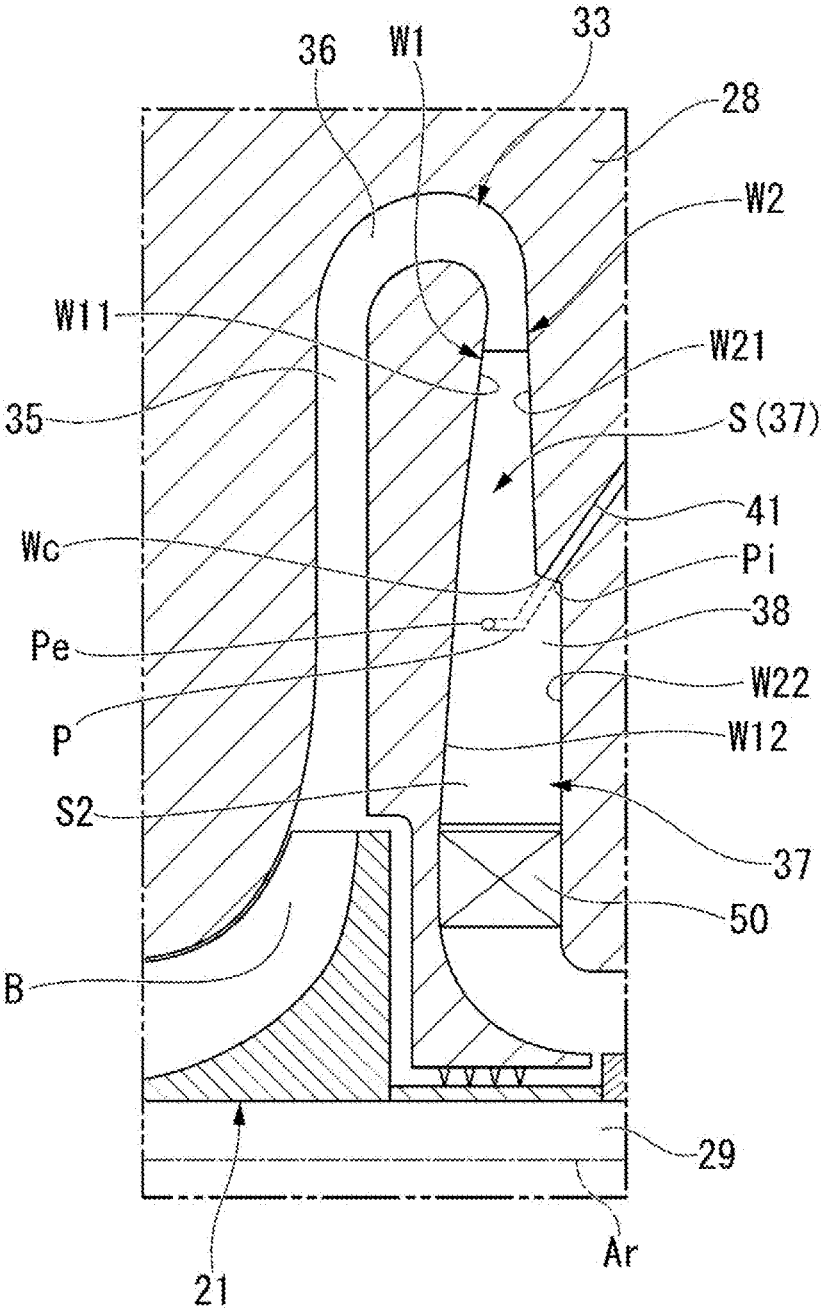
FIG. 3 is an enlarged cross-sectional view of a main portion of a centrifugal compressor according to an embodiment of the present disclosure.

As illustrated in FIG. 3, in a cross section including the axial line Ar, a pair of wall surfaces forming the straight flow path 37 are a hub side wall surface W1 and a shroud side wall surface W2, respectively. In other words, the hub side wall surface W1 forms a wall surface on one side of the straight flow path 37 in the axial line Ar direction, and the shroud side wall surface W2 forms a wall surface on the other side of the straight flow path 37 in the axial line Ar direction. The hub side wall surface W1 and the shroud side wall surface W2 face each other from both sides in the axial line Ar direction. The hub side wall surface W1 and the shroud side wall surface W2 form a placement region S for disposing the return vanes 38.

A variable vane 50 capable of changing the angle in accordance with the operating situation is provided in the intake flow path 34 of the return flow path 33 (that is, the flow path inlet of the second impeller 22). A plurality of variable vanes 50 are arranged at intervals in the circumferential direction with respect to the axial line Ar. The plurality of variable vanes 50 are driven by a drive device 51 to change angle (see FIG. 2).

Furthermore, as illustrated in FIG. 3, an intermediate suction chamber 40 that supplies the refrigerant gas generated by the economizer 7 to the second impeller 22 by merging the refrigerant gas with the discharge flow of the first impeller 21 is provided at an intermediate position of the shroud side wall surface W2 along the straight flow path 37. The intermediate suction chamber 40 is an annular space surrounding the inlet portion of the second impeller 22. The slit-shaped intermediate suction port 41 is provided on the radially inner side of the intermediate suction chamber 40.

This intermediate suction port 41 connects the inside of the intermediate suction chamber 40 to a one end Pi (described below) of an internal flow path P of the return vane 38 in the straight flow path 37 of the return flow path. The region on the shroud side wall surface W2 where the one end side (outlet side) of the intermediate suction port 41 is provided is a connecting wall surface Wc. A portion located radially outward from the connecting wall surface Wc is a shroud side upstream surface W21, and a portion located radially inward is a shroud side downstream surface W22. In other words, the shroud side wall surface W2 includes the shroud side upstream surface W21, the connecting wall surface Wc, and the shroud side downstream surface W22.

Configuration of Return Vane

Next, the configuration of the return vane 38 will be described in detail with reference to FIGS. 3 and 4. As illustrated in FIG. 3, the internal flow path P is formed inside the return vane 38. One end (the inlet port Pi) of the internal flow path P communicates with the intermediate suction port 41 described above. In other words, a plurality of intermediate suction ports 41 are provided at equal intervals in the circumferential direction corresponding to the return vanes 38. Accordingly, the entire amount of the refrigerant gas in the intermediate suction chamber 40 is supplied to the internal flow path P via the intermediate suction port 41. The other end of the internal flow path P is an outlet port Pe that opens to the surface of the return vane 38.

Note that the intermediate suction port 41 may be a slit-shaped opening formed on the connecting wall surface We and extending in the circumferential direction. In this case, a portion of the refrigerant gas of the intermediate suction chamber 40 is supplied from the outlet port Pe to the straight flow path 37 through the inlet port Pi via the internal flow path P, and the remainder of the refrigerant gas is discharged from the slit-shaped opening extending in the circumferential direction on the connecting wall surface We to the straight flow path 37.

Figure 4:
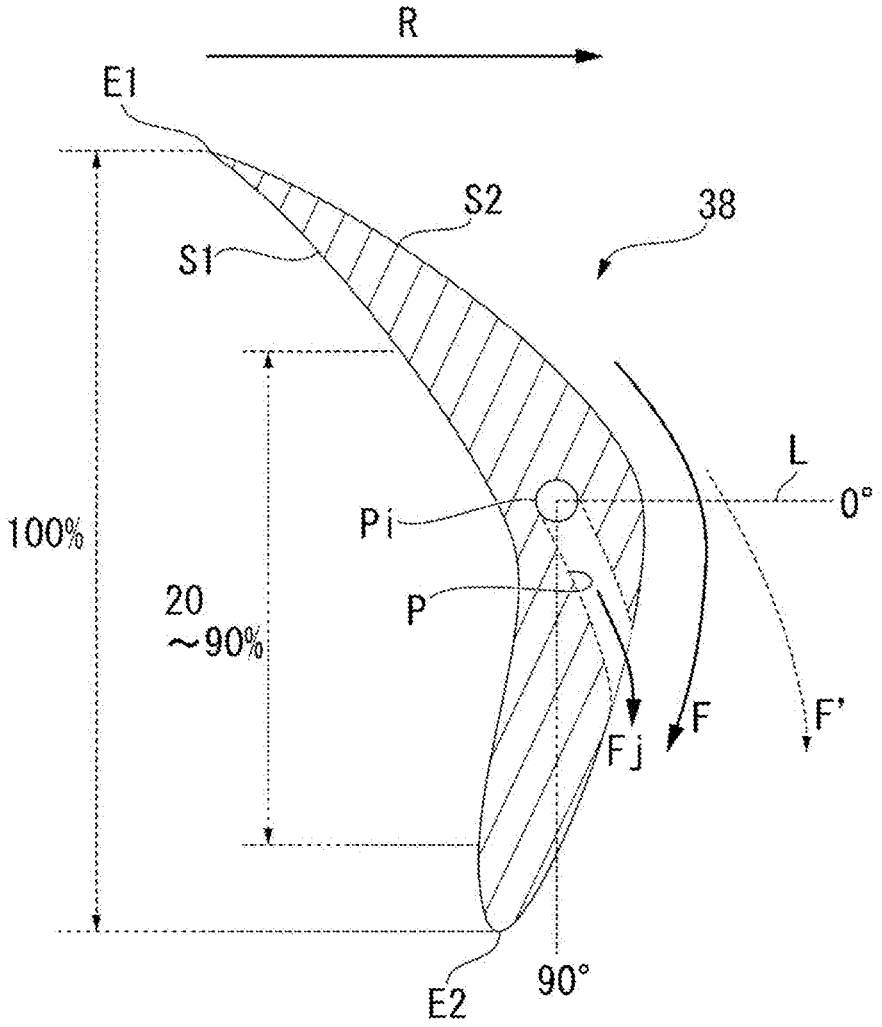
FIG. 4 is a cross-sectional view as seen from an axial line direction of a return vane according to an embodiment of the present disclosure.
Figure 5:
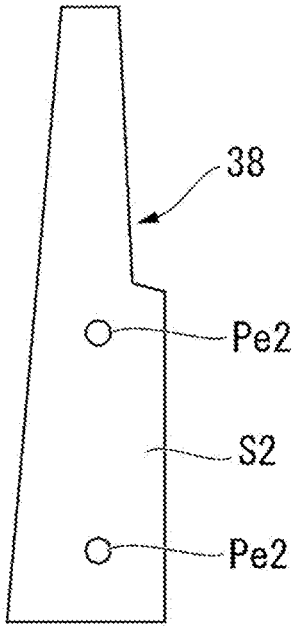
FIG. 5 is a diagram illustrating a modified example of a return vane according to an embodiment of the present disclosure as seen from a suction surface side.

As illustrated in FIG. 4, as seen from the axial line Ar direction, as the return vane 38 extends from a radially outer leading edge E1 to a radially inner trailing edge E2, the return vane 38 is curved from the front side toward the rear side in a rotation direction R of the rotation shaft 29. The surface facing the rear side in the rotation direction R of the return vane 38 is a curved pressure surface S1 recessed toward the rear side. The surface facing the front side in the rotation direction R of the return vane 38 is a curved suction surface S2 that projects toward the front side.

The outlet port Pe of the internal flow path P described above opens at the suction surface S2 of the return vane 38. The opening shape of the outlet port Pe is circular. In addition, in the present embodiment, only one outlet port Pe is formed in each of the return vanes 38.

Here, when the chord length of the return vane 38 is 100%, the outlet port Pe is desirably formed within a range from 20% to 90% based on the leading edge E1. More desirably, the outlet port Pe is formed within a range from 30% to 85% based on the leading edge E1. Most desirably, the outlet port Pe is formed within a range from 50% to 80% based on the leading edge E1.

As illustrated in FIG. 4, it is desirable that the internal flow path P be slightly curved from the front side to the back side in the rotation direction R as the internal flow path P extends from the inlet port Pi toward the outlet port Pe. This causes the flow direction of the fluid ejected from the outlet port Pe to be in a direction along the suction surface S2. More specifically, the outlet port Pe opens tangentially to the position at which the outlet port Pe is formed on the suction surface S2. Note that the opening direction of the outlet port Pe (that is, the direction in which the fluid is ejected) is within the following range. In other words, the opening direction of the outlet port Pe is within a range from 0° to 90° radially inward from a reference line L, where the reference line L extending from the one end (the inlet port Pi) of the internal flow path P toward the front side in the rotation direction R is set as a 0° position. In other words, the opening direction of the outlet port Pe is a direction that includes a tangential component of the suction surface S2, as seen from the axial line Ar direction, facing radially inward. Note that, as long as the outlet port Pe satisfies the conditions described above, the internal flow path P need not necessarily be curved and may be formed in a straight line. Such a case is advantageous in that machining can be performed easily.

Operational Effects

The return vane 38 is provided in the straight flow path 37 to remove the swirling flow component of the fluid by changing the direction of the flow. For this reason, in the region on the suction surface S2 side of the return vane 38 near the trailing edge E2 (downstream side), the flow may fail to follow the suction surface and separate (dashed line arrow F' in FIG. 4). A significant amount of such separation leads to loss, which may affect the performance of the compressor. In particular, since the centrifugal compressor 2 described above is provided with the variable vane 50 radially inward from the return vane 38, it is difficult to ensure the length of the return vane 38 itself. This makes it particularly likely that separation occurs as described above.

Thus, in the present embodiment, the fluid is ejected through the internal flow path P of the return vane 38 as a jet stream Fj on the suction surface S2 of the return vane 38. In this way, the flow F' that tends to separate is drawn toward the suction surface S2 side by the Coandă effect of the jet stream Fj (solid line arrow F in FIG. 4). In other words, separation of the flow at the suction surface S2 can be suppressed by the jet stream Fj. As a result, the performance of the centrifugal compressor 2 can be further improved. In particular, when the required supply amount of refrigerant gas from the intermediate suction chamber 40 is small, the total amount can be supplied from the suction surface S2 of the return vane 38 to suppress the separation of the flow from the return vane 38. Note that in a case where the required supply amount of the refrigerant gas from the intermediate suction chamber 40 exceeds the required supply amount for suppressing separation at the suction surface S2 of the return vane 38, the partial discharge of the refrigerant gas from the slit-shaped opening described above can reduce the pressure loss of the refrigerant gas.

Also, in a device such as the centrifugal compressor 2 according to the present embodiment that is provided with the intermediate suction port 41, when fluid is directly supplied into the straight flow path 37 without passing through the internal flow path P described above, a mixing loss may occur between the main flow flowing through the straight flow path 37 and the flow supplied from the intermediate suction port 41. This affects the performance of the centrifugal compressor 2. However, in the present embodiment, the internal flow path P communicates with the intermediate suction port 41, and the fluid is supplied into the straight flow path 37 along the suction surface S2 via the internal flow path P. In this way, mixing loss caused by meeting the primary flow can be suppressed. As a result, the performance of the centrifugal compressor 2 can be further improved.

In particular, according to the configuration described above, the jet stream Fj is ejected from the outlet port Pe in a direction that includes the tangential component of the suction surface S2. In this way, the Coandă effect from the jet stream Fj is further strongly expressed. As a result, the flow F' that tends to separate is pulled more strongly toward the suction surface S2 side due to the Coandă effect. Accordingly, the likelihood of the flow separating at the suction surface S2 side can be further reduced.

Here, in the range from the leading edge E1 of the return vane 38 to 20 to 90%, the return vane 38 is greatly curved, so it is particularly easy for the flow at the suction surface S2 side to separate. According to the configuration described above, the outlet port Pe is formed in this greatly curved portion. The jet stream Fj ejected from the outlet port Pe can effectively develop a Coandă effect at the portion where separation is particularly likely to occur and draw the stream toward the suction surface S2 side. As a result, the likelihood of the flow separating can be further reduced.

Other Embodiments

The embodiment of the present disclosure is described above in detail with reference to the drawings. However, a specific configuration is not limited to this embodiment, and also includes design change or the like without departing from the gist of the present disclosure.

For example, in the embodiment described above, a single outlet port Pe is formed in the suction surface S2. However, the outlet port Pe is not limited to this embodiment, and it is also possible to adopt the configurations of the modified examples illustrated from FIGS. 5 to 10.

In the examples of FIGS. 5 to 9, a plurality (two) of the outlet ports Pe2 are formed on the suction surface S2 at intervals in the radial direction. According to such a configuration, it is possible to suppress separation of the flow described above in a wider range in the radial direction.

Figure 6:
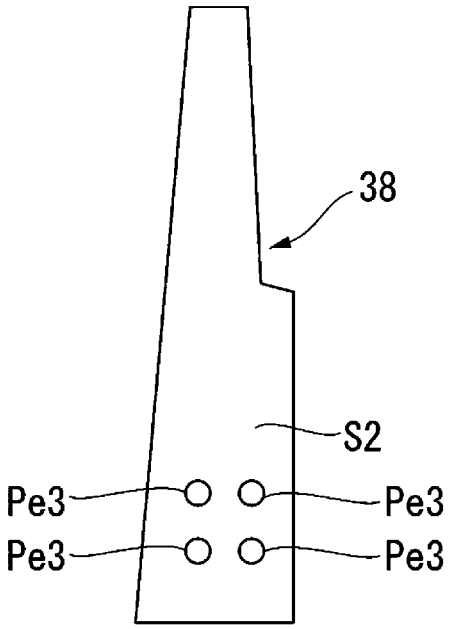
FIG. 6 is a diagram illustrating another modified example of a return vane according to an embodiment of the present disclosure as seen from a suction surface side.

Furthermore, in the example of FIG. 6, a plurality (four) of outlet ports Pe3 are formed on the suction surface S2 at intervals in the radial direction and the axial line Ar direction. According to such a configuration, it is possible to suppress separation of the flow described above in a wide range in the radial direction as well as the axial line Ar direction.

Figure 7:
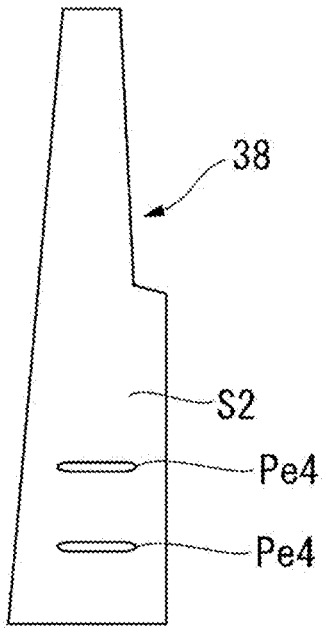
FIG. 7 is a diagram illustrating yet another modified example of a return vane according to an embodiment of the present disclosure as seen from a suction surface side.
Figure 8:
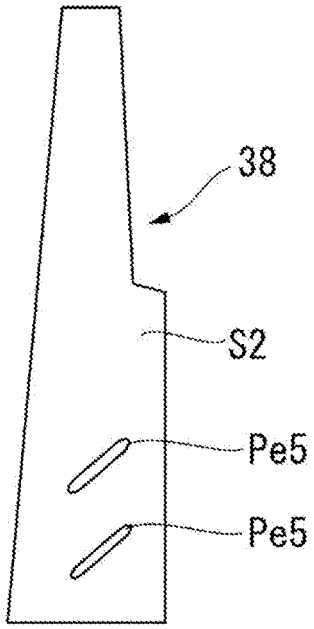
FIG. 8 is a diagram illustrating still yet another modified example of a return vane according to an embodiment of the present disclosure as seen from a suction surface side.
Figure 9:
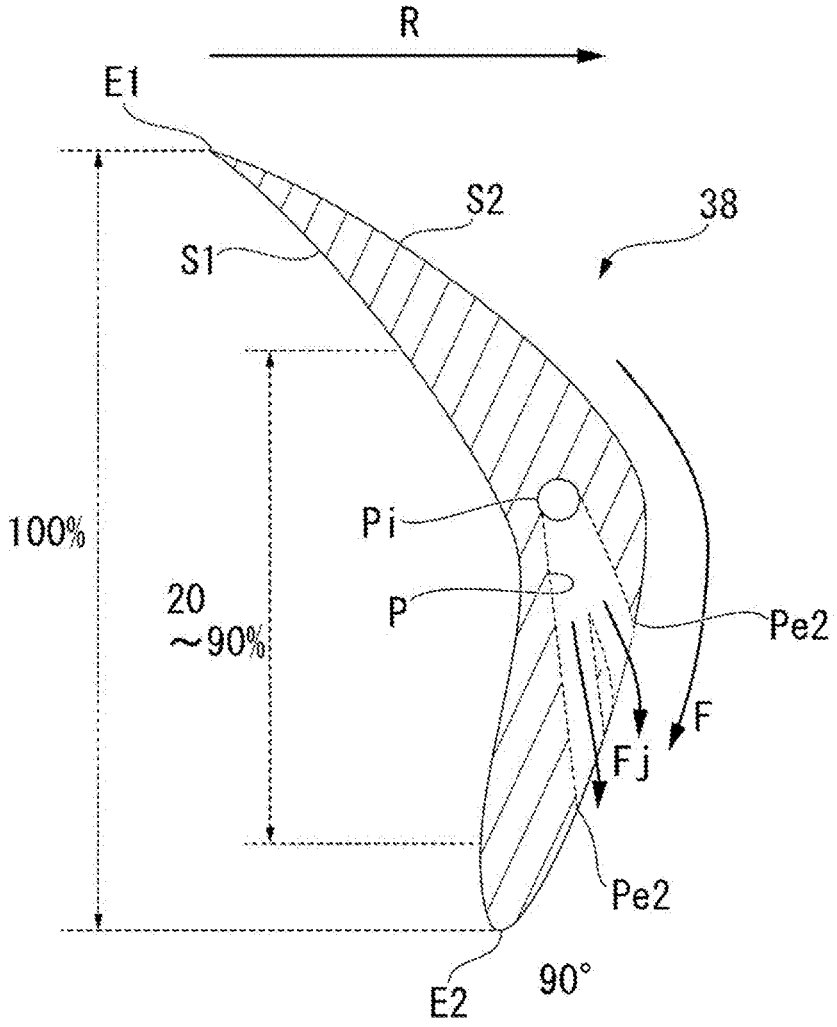
FIG. 9 is a diagram illustrating a modified example of a return vane according to an embodiment of the present disclosure as seen from an axial line direction.
Figure 10:
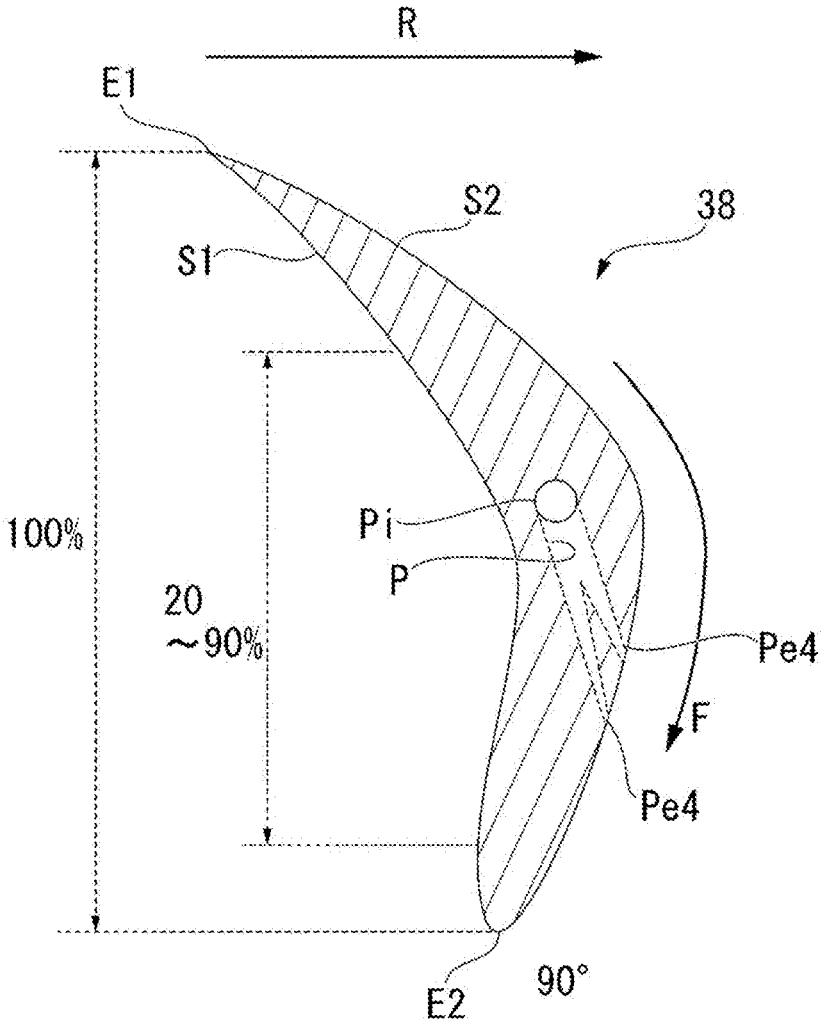
FIG. 10 is a diagram illustrating another modified example of a return vane according to an embodiment of the present disclosure as seen from an axial line direction.

The shape of the outlet port is not limited to a circular shape and may be rectangular or slit-shaped. In the examples of FIGS. 7 and 10, a plurality of slits (two) are formed as outlet ports Pe4 with the longitudinal direction aligned with the axial line Ar direction. The outlet ports Pe4 are arranged in a plurality (two) spaced radially apart. Also, in the example of FIG. 8, a slit extending in a direction including a radial component and an axial line Ar direction component is formed on the suction surface S2 as an outlet port Pe5. According to such a configuration, it is possible to suppress separation of the flow in a wider range on or above the suction surface S2.

Note that in the embodiments described above, the centrifugal compressor 2 is provided with the variable vane 50. However, it is also possible to adopt a configuration in which the variable vane 50 is not provided. In this case, the diameter can be reduced while maintaining the performance of the centrifugal compressor, allowing the overall turbo chiller to be made more compact.

Notes

The centrifugal compressor according to the embodiments described above can be understood as follows, for example.

(1) A centrifugal compressor 2 according to a first aspect includes:

a rotation shaft 29 that rotates about an axial line Ar;

an impeller 21 provided on the rotation shaft 29, the impeller 21 rotating about the axial line Ar;

a casing 28 that forms a return flow path 33 including:

a return bend section 36 that turns around the fluid flowing from the impeller 21 radially outward to flow radially inward, and a straight flow path 37 connected to a downstream side of the return bend section 36, the straight flow path 37 guiding the fluid radially inward; and a return vane 38 provided in a plurality in a portion of the straight flow path 37 arranged at intervals in a circumferential direction, the return vane 38 including a suction surface S2 facing a front side of a rotation direction of the rotation shaft 29, and a pressure surface S1 facing a rear side of the rotation direction of the rotation shaft; wherein the casing 28 includes a hub side wall surface W1 and a shroud side wall surface W2 that form a placement region S of the return vanes 38 in the straight flow path 37, and an intermediate suction port 41 formed on the shroud side wall surface W2, the intermediate suction port ejecting fluid guided from outside toward the straight flow path 37; and inside the return vane 38, an internal flow path P is formed in which one end communicates with the intermediate suction port 41 and another end is an outlet port Pe that opens to the suction surface S2 of the return vane 38.

According to the configuration described above, the fluid can be ejected through the internal flow path P of the return vane 38 as a jet stream Fj on the suction surface S2 of the return vane 38. In this way, the flow F' that tends to separate from the suction surface S2 is drawn toward the suction surface S2 side by the Coandă effect of the jet stream Fj. In other words, separation of the flow at the suction surface S2 can be suppressed by the jet stream Fj.

(2) In the centrifugal compressor 2 according to a second aspect, an opening direction of the outlet port Pe, as seen from one side in the axial line Ar direction, is within a range from 0° to 90° radially inward from a reference line L extending from one end of the internal flow path toward the front side in the rotation direction, where the reference line L is set as a 0° position.

According to the configuration described above, the flow direction of the jet stream Fj ejected from the outlet port Pe can be directed along the suction surface S2. Accordingly, the likelihood of the flow separating at the suction surface S2 radially inward from the outlet port Pe can be further reduced.

(3) In the centrifugal compressor 2 according to a third aspect, an opening direction of the outlet port Pe, as seen from the axial line Ar direction, is a tangential direction of the suction surface S2 that faces radially inward.

According to the configuration described above, the jet stream Fj is ejected from the outlet port Pe in a direction that includes the tangential component of the suction surface S2. In this way, the Coandă effect from the jet stream Fj is further strongly expressed. As a result, the flow F' that tends to separate is pulled more strongly toward the suction surface S2 side due to the Coandă effect. Accordingly, the likelihood of the flow separating at the suction surface S2 side can be further reduced.

(4) In the centrifugal compressor 2 according to a fourth aspect, when the chord length of the return vane 38 is 100%, the outlet port Pe is formed within a range from 20% to 90% based on a leading edge E1, which is a radially outer end edge of the return vane 38.

Here, in the range from the leading edge E1 of the return vane 38 to 20 to 90%, the return vane 38 is greatly curved, so it is particularly easy for the flow at the suction surface S2 side to separate. According to the configuration described above, the outlet port Pe is formed in this greatly curved portion. The jet stream Fj ejected from the outlet port Pe can develop a Coandă effect at the portion where separation is particularly likely to occur and draw the stream toward the suction surface S2 side.

(5) In the centrifugal compressor 2 according to a fifth aspect, in the return vane 38, a plurality of the outlet ports Pe3 are formed arranged at intervals in the axial line Ar direction on the suction surface S2.

According to the configuration described above, it is possible to reduce the likelihood of flow separation occurring in a wide range in the axial line Ar direction.

(6) In the centrifugal compressor 2 according to a sixth aspect, in the return vane 38, a plurality of the outlet ports Pe2 are formed arranged at intervals in a radial direction on the suction surface S2.

According to the configuration described above, it is possible to reduce the likelihood of flow separation occurring in a wide range in the radial direction.

(7) In the centrifugal compressor 2 according to a seventh aspect, the outlet port Pe4 (Pe5) is a slit extending in a direction including the axial line Ar direction and/or a radial direction.

According to the configuration described above, it is possible to reduce the likelihood of flow separation occurring in a wide range in the axial line Ar direction and/or the radial direction.

While preferred embodiments of the invention have been described as above, it is to be understood that variations and modifications will be apparent to those skilled in the art without departing from the scope and spirit of the invention. The scope of the invention, therefore, is to be determined solely by the following claims.

The invention claimed is:

1. A centrifugal compressor, comprising:

a rotation shaft that rotates about an axial line;

an impeller provided on the rotation shaft, the impeller rotating about the axial line;

a casing that forms a return flow path including a return bend section that turns around the fluid flowing from the impeller radially outward to flow radially inward, and a straight flow path connected to a downstream side of the return bend section, the straight flow path guiding the fluid radially inward; and a return vane provided in a plurality in a portion of the straight flow path arranged at intervals in a circumferential direction, the return vane including a suction surface facing a front side of a rotation direction of the rotation shaft, and a pressure surface facing a rear side of the rotation direction of the rotation shaft; wherein the casing includes a hub side wall surface and a shroud side wall surface that form a placement region of the return vanes in the straight flow path, and an intermediate suction port formed on the shroud side wall surface, the intermediate suction port ejecting fluid guided from outside toward the straight flow path; and inside the return vane, an internal flow path is formed in which one end communicates with the intermediate suction port and another end is an outlet port that opens to the suction surface of the return vane.

2. The centrifugal compressor according to claim 1, wherein an opening direction of the outlet port, as seen from one side in the axial line direction, is within a range from 0° to 90° radially inward from a reference line extending from the one end of the internal flow path toward the front side in the rotation direction, where the reference line is set as a 0° position.

3. The centrifugal compressor according to claim 1, wherein an opening direction of the outlet port, as seen from the axial line direction, is a tangential direction of the suction surface that faces radially inward.

4. The centrifugal compressor according to claim 1, wherein when the chord length of the return vane is 100%, the outlet port is formed within a range from 20% to 90% based on a leading edge, which is a radially outer end edge of the return vane.

5. The centrifugal compressor according to claim 1, wherein in the return vane, a plurality of the outlet ports are formed arranged at intervals in the axial line direction on the suction surface.

6. The centrifugal compressor according to claim 1, wherein in the return vane, a plurality of the outlet ports are formed arranged at intervals in a radial direction on the suction surface.

7. The centrifugal compressor according to claim 1, wherein the outlet port is a slit extending in a direction including the axial line direction and/or a radial direction.

* * * * *